United States Patent [19]

Matsuoka

[11] Patent Number: 4,615,047

[45] Date of Patent: Oct. 7, 1986

[54] SHAMPOO CAPE

[75] Inventor: Kyusuke Matsuoka, Aichi, Japan

[73] Assignee: Redken Laboratories, Inc., Canoga Park, Calif.

[21] Appl. No.: 793,278

[22] Filed: Oct. 31, 1985

[51] Int. Cl.[4] ..... A41B 13/10

[52] U.S. Cl. ..... 2/50

[58] Field of Search ..... 2/50, 88, 48

[56] References Cited

U.S. PATENT DOCUMENTS 2,851,690 9/1958 Jennings ..... 2/50

FOREIGN PATENT DOCUMENTS 55-174813 12/1980 Japan .

56-394619 9/1981 Japan .

55-174003 11/1983 Japan .

603350 6/1948 United Kingdom ..... 2/50

*Primary Examiner*—Doris L. Troutman

*Attorney, Agent, or Firm*—Christie, Parker & Hale

[57] ABSTRACT

A shampoo cape has a central C-shaped opening connected to one edge of the cape by a slit. A flap is secured on the back of the cape on the outside with a U-shaped opening in the flap secured along a portion of the C-shaped opening in the cape. A crescent shaped neck pad is sealed in a pocket integral with the flap. When used, the flap hangs into a backbar sink for retaining water in the sink and the neck cushion supports the nape of the user's neck away from the hard edge of the sink.

10 Claims, 3 Drawing Figures

10
18
16
14
18
19
13
3
17
21
22
3

SHAMPOO CAPE

BACKGROUND

This invention concerns a cape for use when shampooing hair in hair treatment salons.

When a person is receiving a shampoo in a hair treating salon, the customer ordinarily leans back with her neck in the U-shaped opening of a backbar sink. This may permit some of the hair to be immersed in water in the sink, and water or the like poured or sprayed over the hair drains into the sink. Such shampooing is widely practiced for its own sake and as a preparatory step for hair coloring, permanent waves, styling and similar hair treatments. Hair tints may also be applied at a backbar sink.

It is important for maintaining good relations with the customer that such shampooing be as comfortable and tidy as possible. Resting the nape of the neck on the cold hard edge of the backbar sink can be uncomfortable. Water or hair treating solutions may be splashed through the slot in the front of the backbar sink, which is at least untidy and inconvenient, and at worst may damage the clothing of the person being shampooed.

It is therefore desirable to provide a means for minimizing discomfort and loss of water from the sink.

BRIEF SUMMARY OF THE INVENTION

There is, therefore, provided in practice of this invention according to a presently preferred embodiment, a shampoo cape comprising a relatively larger sheet of waterproof flexible plastic having a generally C-shaped opening connected to one edge of the sheet by a slit for forming a body covering cape, and a relatively smaller sheet of waterproof flexible plastic having a generally U-shaped opening at one edge. The perimeter of the U-shaped opening is secured to the larger sheet along a portion of the perimeter of the C-shaped opening. A generally crescent shaped neck cushion is contained in a generally crescent shaped sealed pocket on the smaller sheet with its concave edge adjacent the U-shaped opening. Preferably the cape has a collar secured around a major portion of the C-shaped opening with interengaging means on the ends of the collar for securing the ends together around the neck of a user of the cape.

When used, the smaller sheet is at the nape of the neck of the user and lies as a flap in the backbar sink to keep water in the sink, while the cushion rests in the opening of the sink to cushion the user's neck.

DRAWINGS

These and other features and advantages of the present invention will be appreciated as the same becomes better understood by reference to the following detailed description when considered in connection with the accompanying drawings wherein.

DESCRIPTION

Figure 1:
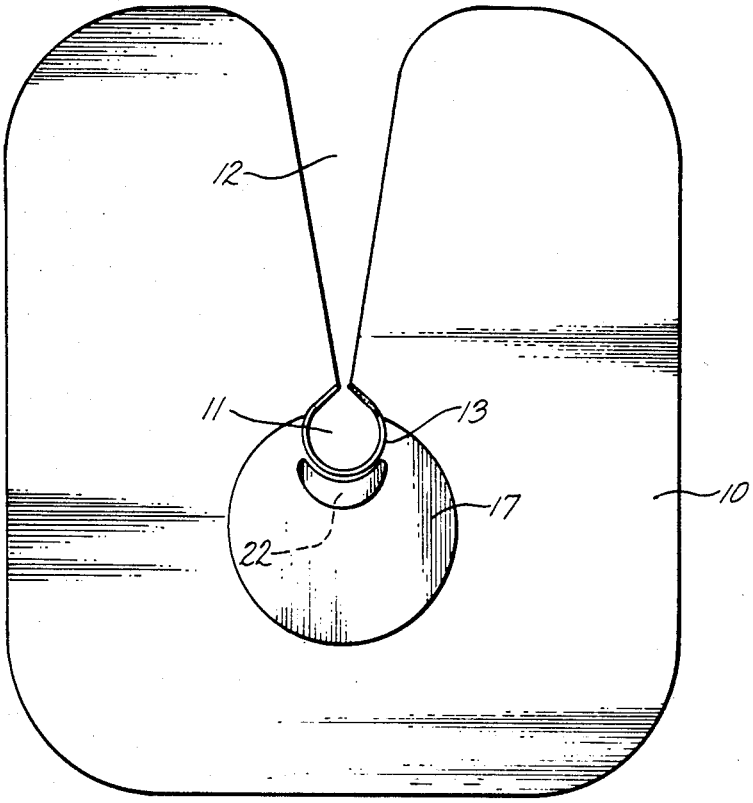
FIG. 1 is a plan view of the upper side of a shampoo cape.
Figure 3:
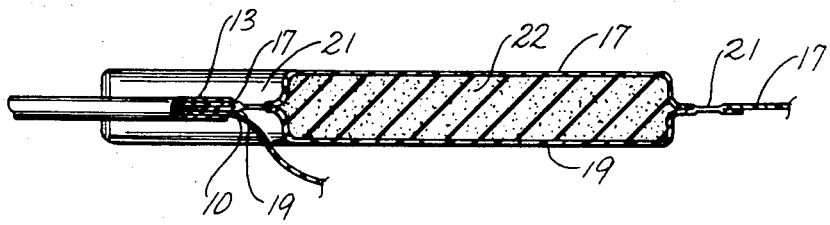
FIG. 3 is a fragmentary transverse cross section at line 3—3 of FIG. 2.
Figure 2:
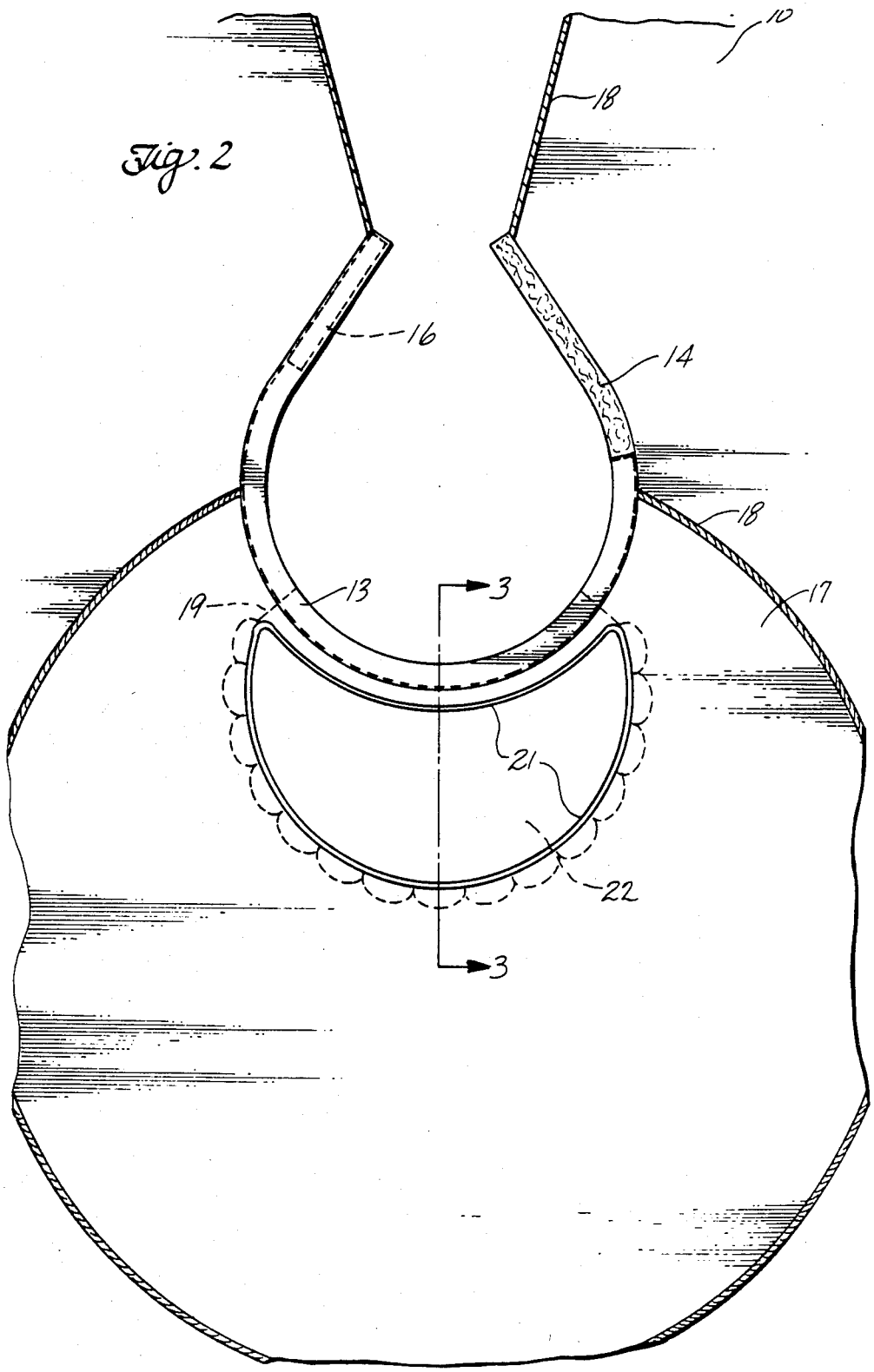
FIG. 2 is a fragmentary enlargement of a center portion of the cape.

The principal portion of the cape is in the form of a relatively large sheet 10 of waterproof flexible plastic that is roughly rectangular with generously rounded corners. The plastic sheet is sufficiently soft and flexible to drape over a person's shoulders as a cape. Exemplary materials for forming such a sheet comprise five mil polyvinyl acetate, polyvinyl chloride, or polyvinyl butyrate with reinforcing nylon fibers embedded in the plastic to provide considerable strength without significantly diminishing the flexibility or softness of the plastic. Any of a variety of waterproof and preferably hydrophobic plastics can be used. It is preferred that the plastic be hydrophobic so that it resists "wicking" of water between the cape and sink.

Approximately in the center of the large sheet is a generally C-shaped opening 11. The open edge of the C-shaped opening is connected to one edge of the sheet by a deep V-shaped slit 12. A binding ribbon 13 is folded over the edge of the sheet and stitched around the perimeter of the C-shaped opening to form a narrow collar around the opening. The binding can be a nylon fabric or preferably is also a soft waterproof plastic sheet.

At each end of the collar there is one moiety of a fastener for connecting the two ends of the binding together and closing the C-shaped opening. Thus, on the underside of one end of the collar there is the loop pile portion 14 of a hook and pile fabric pair such as Velcro. The hook portion 16 of the Velcro pair is stitched on the opposite end of the collar, so that when the two hook and pile strips are in face-to-face engagement they can connect the ends of the C-shaped opening together. When in use the cape is draped over the shoulders of the user with the V-shaped slit 12 in the front and the Velcro fasteners are engaged so that the collar encircles the neck of the user. The edges of the slit can be overlapped in front of the user and if desired additional fasteners can be provided at the edges of the slit to hold it closed.

On the upper side of the larger sheet forming the cape there is a relatively smaller, approximately circular sheet 17 which forms a sink flap. The flap 17 is preferably made of the same plastic material as the large sheet. At one edge of the flap there is a shallow, generally U-shaped opening, the edge of which is substantially similar to the center portion of the edge of the C-shaped opening in the larger sheet. This U-shaped edge of the flap fits inside the binding 13 and the flap is thereby held in place on the larger sheet by the stitching of the collar. Preferably an overlock stitching 18 is applied at all exposed edges of the two sheets for a finished appearance and to avoid cracking at the edges.

A still smaller crescent shaped sheet 19 of similar plastic has its concave edge within the binding 13 between the larger sheet and the flap. The convex edge of the crescent shaped sheet 19 is scalloped to give a finished appearance even though normally hidden by the flap. A heat seal 21 is formed between the crescent shaped sheet 19 and the flap 17 to form a sealed, generally crescent shaped pocket. A crescent shaped resilient foam plastic cushion 22 fits snugly in the pocket with its concave edge adjacent to the U-shaped opening in the flap. If desired the foam plastic cushion may be sealed in the pocket by a cement, however, heat sealing is preferred since rapidly and reliably used in a production environment.

When the cape is put on a user, the small flap 17 hangs down the back below the shoulders. When the person lays back, the flap is placed in the backbar sink. Since the cushion is integral with the flap, this places the flap at the nape of the neck in the U-shaped opening of the backbar sink. This cushions the person's neck from the cold hard edge of the sink. Further, since the cushion is sealed in a pocket, the foam does not soak up any water. The flap hanging down into the sink prevents water from splashing through the opening in the front of the sink and prevents water poured or sprayed on a person's hair from directly reaching the opening in the front of the sink. Thus, the flap retains water in the sink and keeps it off of the floor and user's clothing. The hydrophobic nature of the plastic minimizes wicking of water between the sink and flap.

Although one embodiment of shampoo cape has been described and illustrated herein, modifications and variations will be apparent to one skilled in the art. Thus, for example, instead of having a generally rectangular shape, the large sheet forming the cape may be oval or circular. Similarly, if desired the flap may be oval instead of nearly circular.

The neck cushion may be made of wadded fibers, fabric or particulate material, instead of the foam that is preferred because of its controlled hardness and ease of manufacture in the crescent shape preferred for fitting between the nape of the user's neck and the opening of the backbar sink.

If desired, a drawstring arrangement, buttons, grippers or the like may be used to interconnect the ends of the collar for securing the cape on the user. The hook and pile type fastener is preferred since it is easily manipulated and one size cape fits all users.

Many other modifications and variations will be apparent to one skilled in the art and it is therefore to be understood that within the scope of the appended claims the invention may be practiced otherwise than as specifically described.

What is claimed is:

1. A shampoo cape comprising:

a relatively larger sheet of waterproof flexible plastic having a generally C-shaped opening connected to one edge of the sheet by a slit for forming a body covering cape;

a relatively smaller sheet of waterproof flexible plastic having a generally U-shaped opening at one edge, the perimeter of the U-shaped opening being secured to the larger sheet along a portion of the perimeter of the C-shaped opening;

a generally crescent shaped neck cushion; and a generally crescent shaped sealed pocket on the smaller sheet containing the cushion with its concave edge adjacent to the U-shaped opening.

2. A shampoo cape as recited in claim 1 further comprising a collar secured around a major portion of the C-shaped opening, and interenegaging means on the ends of the collar for securing the ends of the collar together around the neck of the user of the cape, the edge of the U-shaped opening of the smaller sheet also being secured to the collar.

3. A shampoo cape as recited in claim 2 wherein the interengaging means comprises one moiety of a hook and loop pile fastener on one end of the collar and the mating moiety of the hook and loop pile fastener on the other end of the collar.

4. A shampoo cape as recited in claim 1 wherein the C-shaped opening is approximately centrally located in the larger sheet.

5. A shampoo cape as recited in claim 4 wherein the slit is V-shaped with an apex adjacent to the C-shaped opening and a wider end adjacent to the edge of the larger sheet.

6. A shampoo cape as recited in claim 1 wherein the plastic is a hydrophobic plastic.

7. A shampoo cape as recited in claim 6 further comprising overlock stitching around the perimeter of each of the sheets.

8. A shampoo cape as recited in claim 1 wherein the pocket comprises a crescent shaped sheet heat sealed to the smaller sheet around the perimeter of the crescent shaped cushion.

9. A shampoo cape comprising:

a relatively larger sheet of waterproof flexible hydrophobic plastic having approximately in its center a generally C-shaped opening connected to one edge of the sheet by a V-shaped slit for forming a body covering cape;

a relatively smaller sheet of waterproof flexible hydrophobic plastic having a generally U-shaped opening at one edge, the edge of the U-shaped opening being secured to the larger sheet along a portion of the edge of the C-shaped opening;

a generally crescent shaped resilient foam neck cushion;

a generally crescent shaped sheet heat sealed to the smaller sheet around the perimeter of the crescent shaped neck cushion for forming a sealed pocket containing the cushion with its concave edge adjacent to the U-shaped opening;

a collar secured around a major portion of the C-shaped opening overlapping the U-shaped opening for securing the smaller sheet to the larger sheet;

one moiety of a hook and loop pile interengaging means on one end of the collar; and a mating moiety of the hook and pile interengaging means on the other end of the collar for securing the ends of the collar together around the neck of a user of the cape with the smaller sheet hanging as a flap below the shoulders of the user.

10. A shampoo cape as recited in claim 9 wherein the collar also overlaps the concave edge of the crescent shaped sheet.

* * * * *